US005438714A

United States Patent [19]

Shaw

[11] Patent Number: 5,438,714

[45] Date of Patent: Aug. 8, 1995

[54] FRESH WATER MANIFOLD DISTRIBUTION SYSTEM AND METHOD

[75] Inventor: Daniel C. Shaw, Geneva, Fla.

[73] Assignee: Bauer Industries, Inc., Orlando, Fla.

[21] Appl. No.: 429,556

[22] Filed: Oct. 31, 1989

[51] Int. Cl.[6] ..... E03C 1/10; E03C 1/05

[52] U.S. Cl. ..... 4/664; 4/623; 4/661; 4/DIG. 3; 137/357; 137/614.2; 137/883

[58] Field of Search ..... 4/302–305, 4/308, 623, 661, 191, 192, DIG. 3, 249, 313, 663, 664, DIG. 15; 137/861, 883, 386, 608, 357, 512, 614.2; 251/46

[56] References Cited

U.S. PATENT DOCUMENTS

| | | | |
|---|---|---|---|
| 1,755,993 | 4/1930 | Kelley et al. | 137/218 |
| 2,133,804 | 10/1938 | Brooks | 137/218 |
| 2,292,871 | 8/1942 | Dunn | 137/115 X |
| 2,438,207 | 3/1948 | Derby | 4/304 |
| 2,461,830 | 2/1949 | Mahon | 137/527 |
| 2,586,942 | 2/1952 | Grove | 137/512 X |
| 2,786,210 | 3/1957 | Fraser | 4/DIG. 3 |
| 2,908,017 | 10/1959 | Whaley | 4/DIG. 3 |
| 2,931,387 | 4/1960 | Fleming | 137/883 |
| 3,028,966 | 4/1962 | Wiesmann | 137/883 |
| 3,112,497 | 12/1963 | Call | 4/665 X |
| 3,407,842 | 10/1968 | Zahuronec | 137/861 X |
| 3,410,302 | 11/1968 | Frick | 137/883 X |
| 3,566,917 | 3/1971 | White | 137/608 |
| 3,576,277 | 4/1971 | Blackmon | 222/1 |
| 4,036,247 | 7/1977 | Bough | 137/883 X |
| 4,134,163 | 1/1979 | Matsunaga | 4/304 |
| 4,139,469 | 2/1979 | Rainin et al. | 137/512 |
| 4,153,071 | 5/1979 | Black et al. | 137/386 |
| 4,162,218 | 7/1979 | McCormick | 4/665 X |
| 4,309,781 | 1/1982 | Lissau | 4/304 |
| 4,336,918 | 6/1982 | Karbo | 251/46 |
| 4,598,726 | 7/1986 | Pepper | 4/302 X |
| 4,793,588 | 12/1988 | Laverty, Jr. | 4/304 |
| 4,805,247 | 2/1989 | Laverty, Jr. | 4/304 |
| 4,823,414 | 4/1989 | Piersimani et al. | 4/623 |
| 4,893,654 | 1/1990 | Feuz | 137/614.2 |
| 4,914,758 | 4/1990 | Shaw | 4/623 X |
| 4,922,943 | 5/1990 | Gill | 137/1 |

FOREIGN PATENT DOCUMENTS

| | | | |
|---|---|---|---|
| 9375 | 4/1980 | European Pat. Off. | 4/191 |
| 2155984 | 10/1985 | United Kingdom | 137/883 |

*Primary Examiner*—Robert M. Fetsuga
*Attorney, Agent, or Firm*—Joseph W. Berenato, III

[57] ABSTRACT

A fresh water control system comprises a fresh water supply line having a plurality of spaced outlets. At least first and second fresh water manifolds are provided. Each manifold comprises an inlet in flow communication with an associated one of the outlets and at least a first remotely operable valve for selectively supplying fresh water to a remote fixture. At least first and second check valves are provided. The check valves are intermediate the supply line outlets. Each of the check valves permits fresh water to flow therebeyond in a first direction while preventing water from flowing therebeyond in an opposite second direction.

13 Claims, 3 Drawing Sheets

FIG. 1
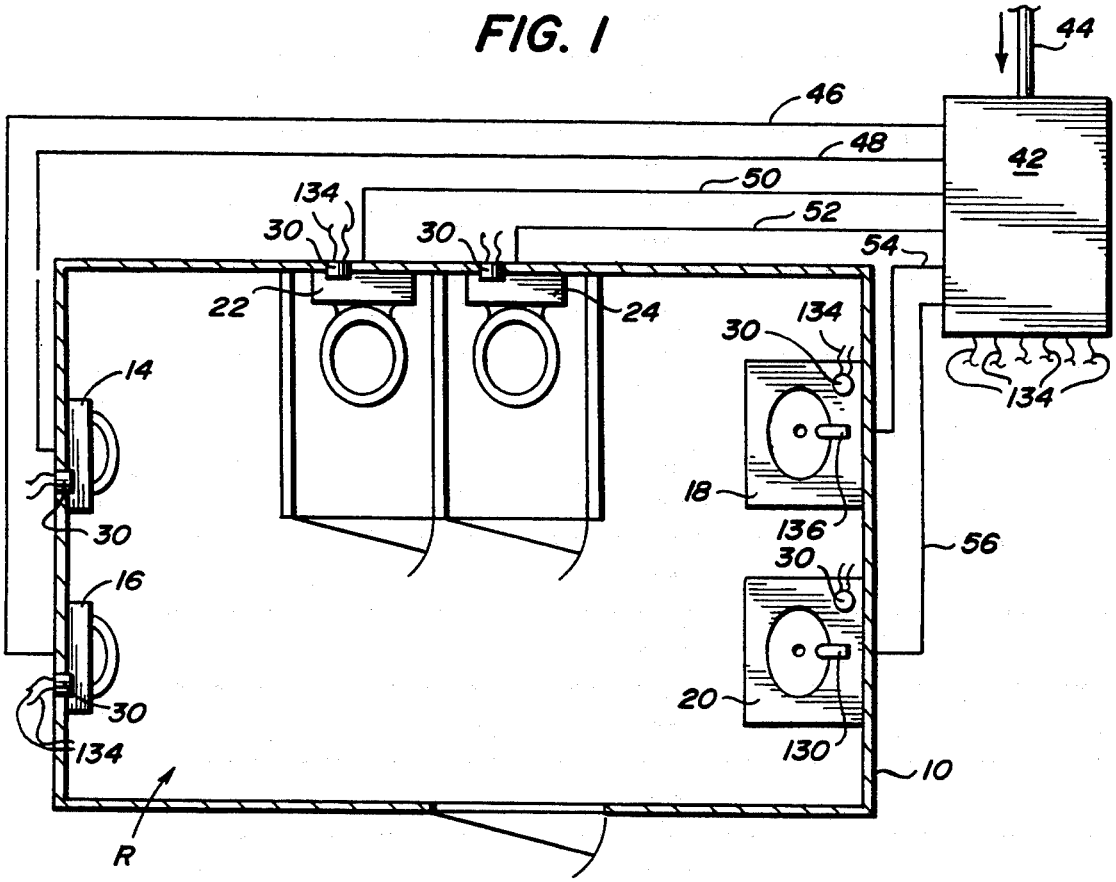
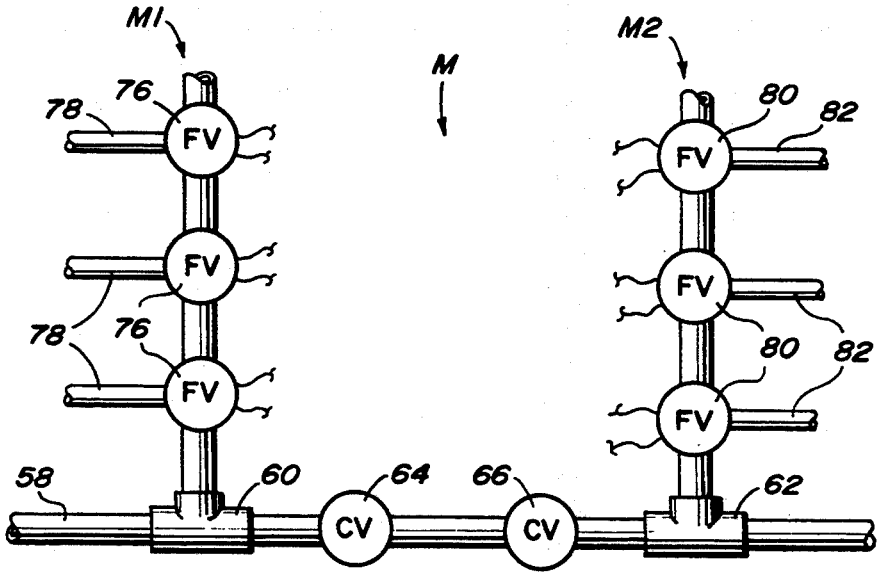
FIG. 2

FRESH WATER MANIFOLD DISTRIBUTION SYSTEM AND METHOD

BACKGROUND OF THE INVENTION

Most high occupancy buildings have a number of shared restrooms. Each such restroom typically has a number of sinks, toilets, and urinals. Each of these plumbing fixtures has at least one fresh water supply line, which supply line is normally operated by means of a local manual flush valve.

The manually operated local valves are subject to abuse. The valves may malfunction or otherwise be rendered always open, with the result that fresh water is unnecessarily dispensed and ultimately required to be treated elsewhere. The locally operated valves have recently also become undesirable because of concern for the spread of infectious disease, thereby sometimes requiring extraordinary maintenance of the restroom.

Various types of sensors have been proposed for causing automatic operation of the local flush valve. Should the sensor detect the presence of a user, then operation of the valve is initiated at some appropriate time. The sensor is itself usually positioned proximate to or integral with the associated flush valve, thereby unnecessarily complicating the mechanism.

The manually operated flush valves are typically connected to a piped water distribution system, thereby requiring couplings, elbows, hangers, and like elements for assuring that the water is communicated from a source to the valve. Installation of these various plumbing components can be both time consuming and expensive, and repair costs are likewise increased because the components are typically disposed behind a wall.

Those skilled in the art will appreciate that there is a need for a fresh water distribution system which minimizes installation and repair costs, which minimizes the possibility for valve abuse, and which minimizes line sizing as a means for further reducing operating costs. The disclosed invention provides these features by virtue of a remotely operated manifold system capable of supplying fresh water to any one or all of a plurality of sinks, toilets and urinals.

OBJECTS AND SUMMARY OF THE INVENTION

The primary object of the disclosed invention is to provide a fresh water distribution system which minimizes repair and maintenance costs, which provides for sanitary distribution of water, and which minimizes the possibility for valve abuse.

An additional object of the disclosed invention is to provide a method of distributing fresh water to any one or all of a plurality of sinks, toilets, and urinals in a manner which avoids contamination of the water flowing to the sinks.

A fresh water control system according to the invention comprises a fresh water supply line having a plurality of spaced outlets. At least first and second fresh water manifolds are provided, and each manifold comprises an inlet in flow communication with an associated one of the outlets and at least a first remotely operable valve means for selectively supplying fresh water to a remote fixture. At least first and second check valve means are operably associated with the water supply line intermediate the outlets, and each of the check valve means permits fresh water to flow therebeyond in a first direction while preventing fresh water from flowing therebeyond in an opposite second direction.

A fresh water distribution system comprises a fresh water supply line having a plurality of outlets. A plurality of manifolds are provided, with each manifold comprising a fresh water inlet in flow communication with an 10 associated one of the outlets and a plurality of solenoid operated flow control valves for selectively distributing water to a plurality of remote associated fixtures. First and second check valves are interposed in the supply line intermediate the manifolds. Each of the check valves permits water to flow in the line to the second manifold and prevents water from flowing from the second to the first manifold. A plurality of infrared sensors are provided. Each sensor is operably associated with one of the flow control valves and is proximate an associated fixture for causing selective operation of the associated flow control valve so that water is supplied to the associated fixture.

A plumbing system comprises an enclosure having a plurality of fixtures comprising at least a first sink and at least a toilet or a urinal disposed therein. A fresh water supply line has a plurality of spaced outlets remote from the enclosure. At least first and second manifolds are provided, with each manifold comprising an inlet in flow communication with one of the outlets and a remotely operable flow control valve. A plurality of supply lines are provided, with each supply line extending between one of the flow control valves and an associated fixture for supplying water thereto. First and second check valves are interposed in the fresh water supply line intermediate the manifolds for permitting fresh water to flow beyond the first manifold to the second manifold, and for preventing water from flowing beyond the second manifold to the first manifold. A plurality of proximity sensors are provided, with each sensor proximate one of the fixtures and operably connected to the associated flow control valve for causing selective operation thereof so that water is selectively supplied to the associated fixture.

The method of controlling the distribution of water within a plumbing system comprises the steps of providing a plurality of fixtures, and at least one of the fixtures is a sink and at least one of the fixtures is a toilet or urinal. First and second manifolds are provided, with each manifold having an inlet in flow communication with a water supply line and a remotely operable control valve having an outlet. The outlet of the first manifold control valve is connected to the sink and the outlet of the second manifold control valve is connected to the toilet or urinal. A sensor is positioned proximate each fixture and determines which of the fixtures requires operation and causes operation of the associated flow control valve. Water in the supply line is permitted to flow beyond the first manifold toward the second manifold when the flow control valve of the second manifold is operating, and water in the supply line is prevented from flowing beyond the second manifold to the first manifold when the flow control valve of the first manifold is operating.

These and other objects and advantages of the invention will be readily apparent in view of the following detailed description of the drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a top plan view, partially in schematic, illustrating a restroom pursuant to the invention;

FIG. 2 is a fragmentary elevational view of a fresh water manifold distribution system according to the invention;

DETAILED DESCRIPTION OF THE INVENTION

Restroom R, as best shown in FIG. 1, comprises a walled enclosure 10 having an access door 12. Urinals 14 and 16 are affixed to one wall of the enclosure 10, while sinks 18 and 20 are affixed to the opposite wall thereof. Toilets 22 and 24 are positioned along a further wall of the enclosure 10. Those skilled in the art will appreciate that there can be a greater or fewer number of the urinals, sinks and toilets, and that their relative positioning can also be altered.

Figure 5:
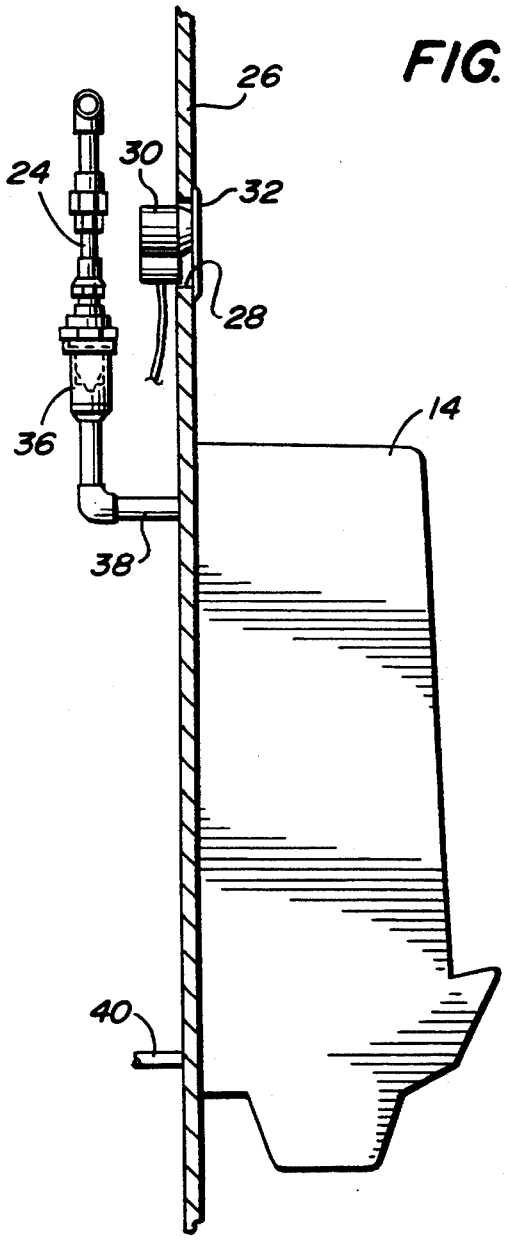
FIG. 5 is a fragmentary side elevational view, partially in section, illustrating a urinal pursuant to the invention.

Urinal 14, as best shown in FIG. 5, is affixed to support wall 26 by means known in the art. Opening 28 is formed in wall 26 in alignment with and above the center of urinal 14. Infrared sensor 30, which may be an active infrared sensor, is positioned so that the eye thereof is 10 disposed within opening 28. Cover plate 32 is disposed over opening 28 and the eye of sensor 30, and preferably has a translucent window for permitting operation of the sensor 30. The sensor 30, by being positioned above and in alignment with urinal 14, detects the presence of a user thereof and the need to cause flushing. Similar sensors 30 are positioned proximate urinal 16 and toilets 22 and 24 and sinks 18 and 20.

Supply line 34 communicates with back flow preventer 36, and ultimately through line 38 to urinal 14. Drain line 40 runs from the urinal 14 to, ultimately, the treatment plant where the water is further processed. While I have illustrated in FIG. 5 the urinal 14, those skilled in the art will understand that a similar arrangement is provided for the urinal 16. Also, each of toilets 22 and 24 and sinks 18 and 20 similarly has a water supply line communicating with the associated fixture, and a drain line likewise leading therefrom.

Remote maintenance enclosure 42, as best shown in FIG. 1, has a fresh water inlet supply line 44 and outlet supply lines 46, 48, 50, 52, 54, and 56 feeding, respectively, urinals 14 and 16, toilets 22 and 24, and sinks 18 and 20. I prefer that the lines 46, 48, 50, 52, 54 and 56 be comprised of resilient, flexible, tubular material in order to minimize installation costs, as well as to reduce line size. Tubing is easier and less expensive to install than pipe, can be readily repaired, and can be sized to handle the flow required.

Figure 7:
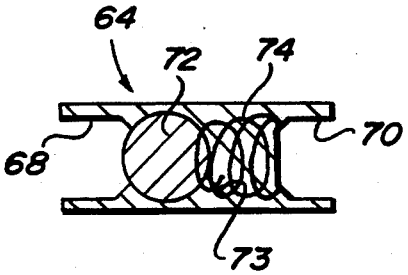

Manifold system M, as best shown in FIG. 2, comprises a fresh water inlet supply line 58, which is, preferably, in flow communication with inlet line 44, and spaced T-couplings 60 and 62 between which in-line check valves 64 and 66 are disposed. Each of the check valves 64 and 66, as best shown in FIG. 7, has an inlet 68 and an outlet 70, with ball 72 selectively blocking the passage 73 therebetween. Spring 74 biases the ball 72 to prevent water from flowing between the outlet 70 and the inlet 68, so that water can only flow from the inlet 68 to the outlet 70. Manifold system is, preferably, positioned within enclosure 42.

A plurality of solenoid operated flow control valves 76 are connected by suitable piping or tubing to one outlet of T-connector 60. A supply line 78 leads from each of the flow control valves 76 to an associated water-consuming fixture. Similar control valves 80 are in flow communication with an outlet of T-connector 62. Supply lines 82 run from each of the control valves 80 to an associated water-consuming fixture. The interconnection of the valves 76, having plural outlets, forms a first manifold M1, while the interconnected valves 80 forms a second manifold M2.

I prefer that the manifold system M be positioned within the remote enclosure 42, which may be a maintenance room, so that the components thereof are not readily accessible to the general public. Remote location of the control valves 76 and 80 minimizes the possibility of valve abuse. Also, since the valves 76 and 80, when ganged together as shown in FIG. 2, provide two manifolds M1 and M2 separated by check valve 64 and 66, then all components are in one location which is readily accessible by maintenance personnel in the event of a failure.

As noted, I prefer that the control valves 76 and 80 each be a solenoid operated valve, since such valves can be operated by an infrared sensor, such as the sensor 30. The flow control valves 76 and 80 should be of the fail closed design, in order to avoid excessive water waste in the event of valve malfunction. Also, as a further means for reducing line size requirements, I prefer that the valves 76 and 80 be of substantially full bore design, thereby minimizing restriction and blockage by diaphragm elements and the like.

Figure 6:
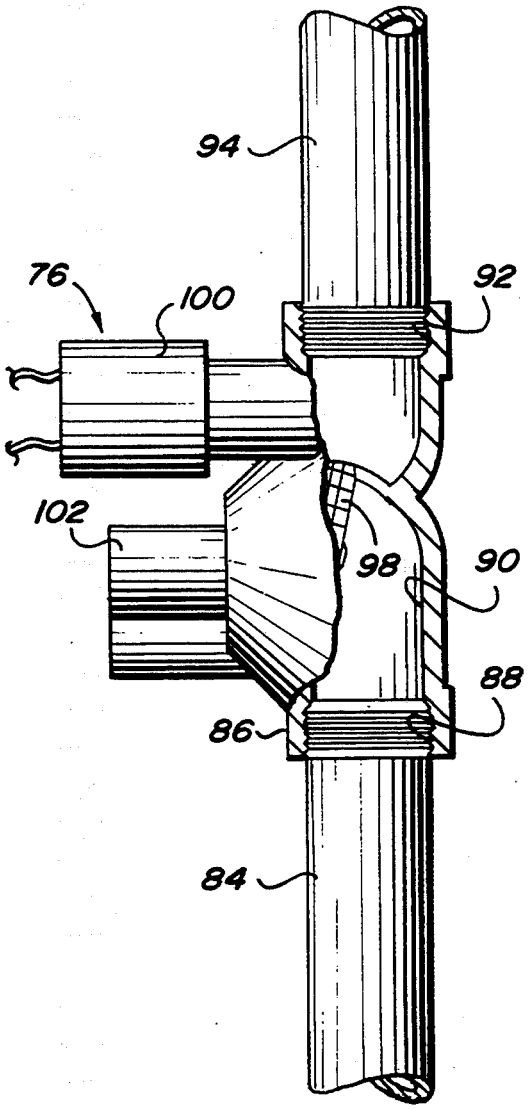
FIG. 6 is a fragmentary elevational view, partially in section, disclosing the solenoid operated control valve of the invention; and, FIG. 7 is a cross-sectional view of a check valve used with the invention.

An exemplary flow control valve 76 is illustrated in FIG. 6. Supply line 84 feeds plastic valve body 86 and the inlet 88 thereof. Throughbore 90 extends between inlet 88 and the oppositely disposed outlet 92, to which outlet supply line 94 is in flow communication. Pivotal diaphragm 98 selectively blocks bore 90 in response to an electrical signal received by controller 100 from a sensor, such as the sensor 30. The controller 100 causes the energization of electromagnet 102, and thereby pivoting of the diaphragm 98. An exemplary control valve 76 is manufactured by Hardie Irrigation pursuant to U.S. Pat. No. 4,336,918, the disclosure of which is incorporated herein by reference.

I prefer the use of remotely operable electromechanical control valves, such as the valves 76 and 80, because they are relatively inexpensive, are easily installed and repaired, and can be initiated by a remotely located device, such as the sensor 30. Furthermore, the electromechanical valve can be operated through a computer control system, such as disclosed in my pending application entitled FRESH WATER CONTROL SYSTEM AND METHOD, U.S. Ser. No. 212,405, filed Jun. 27, 1988, now U.S. Pat. No. 4,914,758 the disclosure of which is incorporated herein by reference. That application discloses a computer control system for regulating simultaneous operation of flow regulating valves as a means for minimizing pressure fluctuations in a water distribution system.

Figure 4:
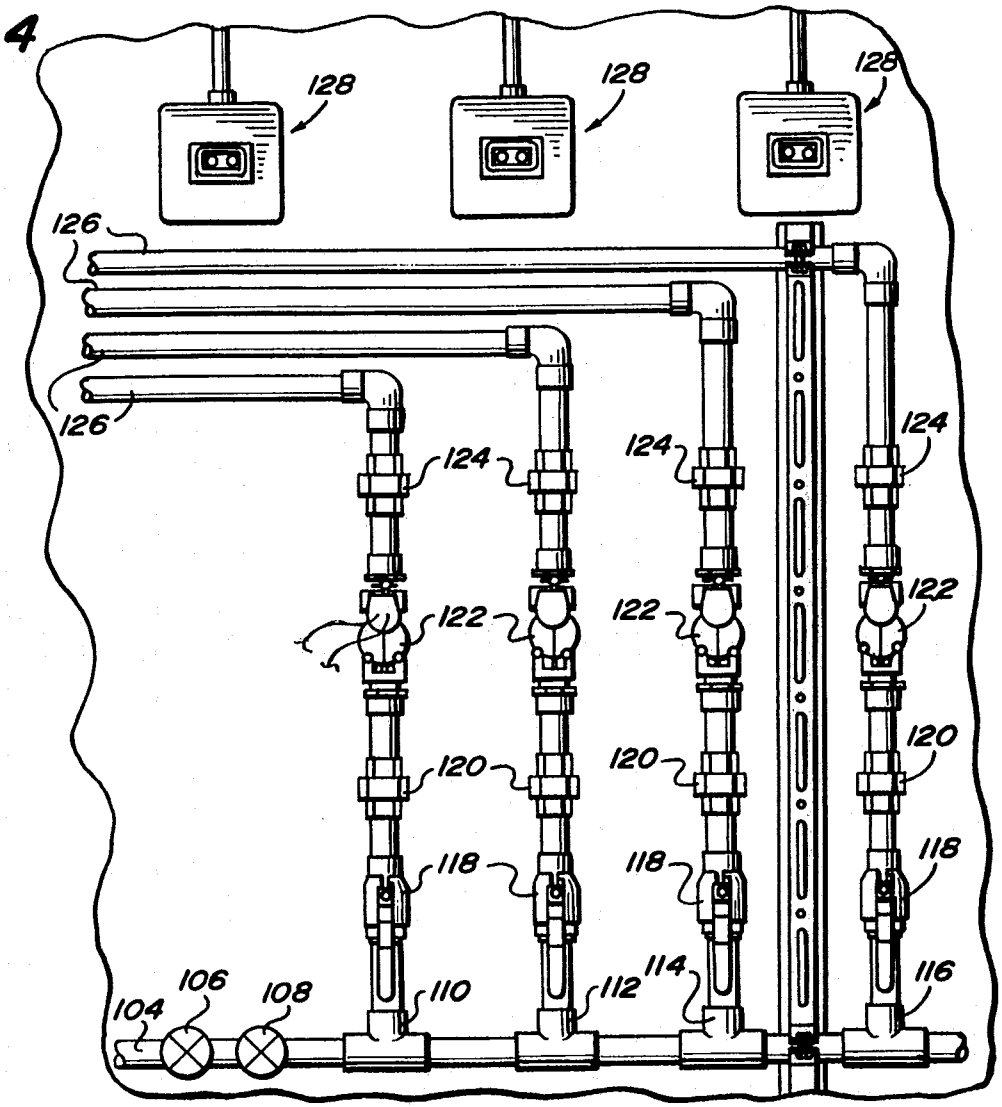
FIG. 4 is a fragmentary front elevational view of a manifold system incorporating the manifold line of FIG. 3.
Figure 3:
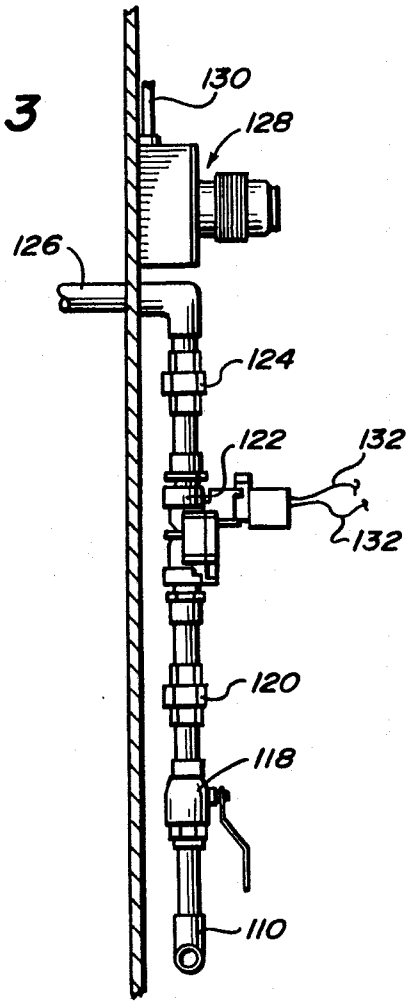
FIG. 3 is a fragmentary elevational view, partially in section, of a manifold line according to the invention.

FIG. 4 discloses a manifold system useful for supplying flushing water to the urinals 14 and 16 and toilets 22 and 24 of the restroom R of FIG. 1. Fresh water supply line 104 leads from a manifold, such as the manifold M1 of FIG. 2, and feeds spring-loaded check valve 106, which in turn feeds like check valve 108. T-couplings 110, 112, 114 and 116 are provided, and form a flow conduit for fresh water supplied via supply line 104. Manually operable shut-off valves 118 are provided in flow communication with each of T-couplings 110, 112, 114 and 116. Threaded unions 120 are downstream of each of valves 118. Electromechanical flow control valves 122, which correspond to the valves 80 of the manifold M2 of FIG. 2, are downstream of unions 120 in order to regulate the flow of water. Unions 124, which correspond to the unions 120, are downstream of each of solenoid operated control valves 122 in order to permit installation and removal of the valves 122 as required. Outlet lines 126 lead from each of unions 124 and communicate with an associated fixture, such as the urinals 14 and 16 and toilets 22 and 24 of the restroom R of FIG. 1, in order to supply flushing water thereto in response to operation of the associated control valve 122.

A 24 VAC Class 2 transformer 128 is provided for each of the valves 122 in order to step down the 110 VAC supplied by power line 130. I prefer that the valves 122 and sensors 30 be operated at 24 VAC, in order to increase safety and avoid the need for conduit and hard wired installations. Leads 132 extend from each of valves 122 to, ultimately, the associated transformer 128. Similar leads 134 extend between each of the sensors 30 and the remote enclosure 42, as best shown in FIG. 1, in order to supply the detection signal to the control means therein. I prefer that the enclosure 42, or some similar site, contain the electrical control system, such as disclosed in my cited pending application, which causes the valves to be operated in response to the detection signal. The control system is, preferably, microprocessor based.

The fresh water supplied to the sinks 18 and 20 must be clean, because it may be used to wash the face and hands. It is also not unheard of for an individual to consume tap water supplied via the faucets 136 of the sinks 18 and 20. The flushing water used by the urinals 14 and 16 and toilets 22 and 24, however, need not be as clean as that supplied to the sinks 18 and 20. Individuals do not normally wash their hands from such fixtures, nor do they consume water supplied thereto. The water supplied to the toilets 22 and 24 and urinals 14 and 16 should be clean enough to avoid unpleasant odors, but need not be of consumable quality.

It would be inordinantly expensive to supply a separate water supply line for each of the manifolds M1 and M2 of FIG. 2. Instead, a single supply line 58 is provided, and the check valves 64 and 66 assure that the water supplied from the line 58 is always available for the manifolds M1 and M2, and none can be siphoned from the manifold M2 to the manifold M1. The manifold M1, because the water supplied by it must be free of the possibility of contamination, is used for supplying the sinks 18 and 20, while the water supplied by the manifold M2 is used for the toilets 22 and 24 and urinals 14 and 16.

There is a possibility that water supplied to or for the use of urinals 14 or 16 or toilets 22 and 24 could be siphoned therefrom in the event some control valve 76 was opened. The siphoned water might not be suitable for consumption, and the check valves 64 and 66 prevent that siphoned water from reaching the manifold M1. I prefer that two check valves 64 and 66 be provided, because this minimizes the possibility of siphoned water migrating beyond one valve. Double check valves essentially eliminate the possibility of siphoned water reaching the manifold M1, and therefore provide increased safety.

Those skilled in the art will appreciate that it is possible to arrange one or more manifolds M1 so that the needs of a plurality of restrooms R and their associated sinks can be met. Similarly, one or more manifolds M2 can likewise be provided for supplying flushing water to the restrooms R. It is merely necessary that some means be provided intermediate the manifolds M1 and M2 to prevent the possibility of siphoned water flowing from the manifold M2 to the manifold M1. I prefer that this means be the check valves 64 and 62, although those skilled in the art will appreciate that various types of approved backflow devices are available, such as a reduced pressure backflow preventer.

While this invention has been described as having a preferred design, it is understood that it is capable of further modifications, uses and/or adaptations thereof, and following in general the principle of the invention and including such departures as come within known or customary practice in the art to which the invention pertains.

What I claim is:

1. Fresh water control system, comprising:

a) a fresh water supply line having a plurality of spaced outlets;

b) at least first and second water manifolds, each manifold comprising an inlet, in flow communication with an associated one of said outlets, and at least a first remotely operable valve means operably associated with each of said manifolds for selectively supplying water to a remote fixture comprising a sink, or a toilet or urinal;

c) at least first and second cooperating check valve means operably associated with said supply line intermediate the outlets to which said manifolds are in flow communication, each of said check valve means for permitting water to flow therebeyond in a first direction while preventing water from flowing therebeyond in an opposite second direction;

d) there are a plurality of said remotely operable first valve means and of said sinks or toilets or urinals;

e) each of said first valve means of said first manifold supplies fresh water only to one of said sinks; and, f) each of said first valve means of said second manifold supplies water only to one of said toilets and/or urinals.

2. The system of claim 1, wherein:

a) each of said check valve means is in line with said water supply line.

3. The system of claim 2, wherein:

a) each of said check valve means is a ball check valve.

4. The system of claim 1, wherein:

a) said first manifold valve means supplies fresh water to a fixture requiring fresh water; and, b) said second manifold valve means supplies fresh water to a fixture not requiring fresh water.

5. The system of claim 1, wherein:

a) each of said first valve means is a solenoid operated flow control valve.

6. The system of claim 5, further comprising:

a) a manually operable flow control valve interposed in each of said manifolds intermediate the associated outlet and the associated solenoid operated flow control valve.

7. The system of claim 5, further comprising:

a) a proximity sensor proximate each of the fixtures and operably connected to an associated one of said solenoid operated flow control valves for causing operation thereof so that fresh water is thereby selectively supplied to the associated fixture.

8. The system of claim 7, wherein:

a) each sensor is an infrared sensor.

9. The system of claim 8, wherein:

a) each sensor is an active infrared sensor.

10. Fresh water distribution system, comprising:

a) a fresh water supply line having a plurality of outlets;

b) a plurality of manifolds, each manifold comprising a fresh water inlet in flow communication with an associated one of said outlets and a plurality of solenoid operated flow control valves for selectively distributing water to a plurality of remote associated fixtures;

c) first and second check valves interposed in said supply line intermediate said manifolds, each of said check valves permitting water to flow in said line to said second manifold and preventing water from flowing from said second manifold to said first manifold;

d) a plurality of infrared sensors, each sensor operably associated with one of said flow control valves and disposed proximate an associated fixture for causing selective operation of the associated flow control valve so that water is supplied to the associated fixture;

e) each flow control valve of said first manifold supplies water only to a fixture requiring fresh water; and, f) each flow control valve of said second manifold supplies only water to a fixture not requiring fresh water.

11. The system of claim 10, wherein:

a) each of said check valves is a ball check valve.

12. The system of claim 10, wherein:

a) each of said infrared sensors is an active sensor.

13. The system of claim 10, further comprising:

a) a plurality of manually operable flow control valves, each manually operable flow control valve interposed between an associated solenoid operated control valve and the associated manifold inlet.

* * * * *